US005354251A

United States Patent [19]

Sleamaker

[11] Patent Number: 5,354,251

[45] Date of Patent: Oct. 11, 1994

[54] MULTIFUNCTION EXCERCISE MACHINE WITH ERGOMETRIC INPUT-RESPONSIVE RESISTANCE

[76] Inventor: Robert H. Sleamaker, 372 Governor Chittenden Rd., Williston, Vt. 05495

[21] Appl. No.: 144,336

[22] Filed: Nov. 1, 1993

[51] Int. Cl.[5] ..... A63B 21/00

[52] U.S. Cl. ..... 482/96; 482/142; 482/51

[58] Field of Search ..... 482/96, 142, 51, 56, 482/71–73, 95, 148; 128/25 R

[56] References Cited

U.S. PATENT DOCUMENTS

| | | | |
|---|---|---|---|
| 4,830,363 | 5/1989 | Kennedy | 482/56 |
| 4,911,438 | 3/1990 | Van Straaten | 482/96 |
| 5,029,848 | 7/1991 | Sleamaker | 482/96 |
| 5,133,700 | 7/1992 | Braathen | 482/51 |
| 5,158,513 | 10/1992 | Reeves | 482/142 |
| 5,224,909 | 7/1993 | Hamilton | 482/51 |

FOREIGN PATENT DOCUMENTS

| | | | |
|---|---|---|---|
| 2356437 | 1/1978 | France | 482/96 |

*Primary Examiner*—Stephen R. Crow
*Attorney, Agent, or Firm*—Donald W. Meeker

[57] ABSTRACT

A roller carriage with paired upper and lower rollers rides on an adjustable inclined monorail. A tension cord connects the carriage to a rear stanchion. Pull cables wind around one-way clutch drivers which drive a rotating shaft, wherein a tension means connected to the one-way clutch drivers rewinds the pull cables to an initial position after extension. The rotating shaft has ergometric input-responsive resistance devices on the shaft. Choices of resistance include a centrifugal clutch, a variable opening encased vaned flywheel, a band brake, a centrifugal brake, a wind load, a water load, an eddy current load, and a variable speed electric motor resistance. Interchangeable body supports are mounted on the roller carriage. A laterally tilting padded swim bench is used with swim paddles attached to the pull cables. A pair of pivoting leg supports may be attached to the padded swim bench to pull another pair of cables attached to the same system. A nordic seat with thigh pads and a lower foot support is used with ski pole grip handles attached to the pull cables. Additional pull cables may be attached to pivoting foot supports with the nordic seat. A canoe/kayak seat with a horizontally spaced foot support is used with a paddle shaft attached to the pull cables. An upright bicycle seat with a handle bar is used with lower pedals or treadles to which pull cables are attached. A recumbent back-support seat is used with horizontally extending pedals, to which pull cables are attached, to form a simulated recumbent bicycle. Stepper pedals may be attached to pull cables and pivotally mounted to the front stanchion as a step exerciser.

20 Claims, 6 Drawing Sheets

MULTIFUNCTION EXCERCISE MACHINE WITH ERGOMETRIC INPUT-RESPONSIVE RESISTANCE

BACKGROUND OF THE INVENTION

1. Technical Field

The present invention relates to exercise machines, and in particular to a multifunction exercise machine with a roller carriage riding on an adjustable angle monorail, interchangeable body supports on the roller carriage, and pull cables which are connected to ergometric input-responsive variable resistance to simulate actual sports activities.

2. Description of the Prior Art

Swimming, nordic skiing, paddling, cycling, and other types of sports exercise require practice and training for best performance, especially when engaged in competition. Actually performing the sports activities when possible (overcoming obstacles such as adverse weather and inadequate access to facilities) provides focused exercise but doesn't offer an adequate opportunity to vary the resistance involved in carrying out the activity to produce increased strength.

There are many exercise devices available on the market for providing cardiovascular and muscular development, but most of them fail to produce a true simulation of the actual sports activity for which the exerciser is training. Part of the difficulty lies in trying to shape exercise equipment to allow the full range of body movement in the same form as in the sport. Another difficulty lies in trying to create resistance in the exercise equipment which simulates actual resistance encountered in a sports activity while in motion in the sport having overcome inertial resistance. Thirdly, the sensation and perception of actually moving as in the sport is missing in most prior art devices.

Exercise equipment is often boring and uninvolving when the exerciser repeats the same action over and over again while remaining in a stationary position on the equipment. In most equipment, the exerciser does not experience the motion experienced in the actual sports activity.

Applicant's U.S. Pat. No. 5,029,848 provides an inclined adjustable monorail with rolling interchangeable body supports moving up and down the inclined monorail to provide body movement during exercise to simulate actual conditions and also provides variable weights attachable to the moving body supports for varying the strength requirement to increase muscular development and cardiovascular endurance. However, the pull system of the applicant's prior patent does not provide variable resistance and the patent does not provide a body support for canoe/kayak paddling, bicycling, full body motion nordic skiing (including arm and leg motion), and full body motion swimming (including arm and leg motion).

DISCLOSURE OF INVENTION

The present invention is an improvement over applicant's U.S. Pat. No. 5,029,848. The pull cables on this improvement wind over pulleys and around one-way clutch drivers which drive a rotating shaft with alternative types of variable resistance input-responsive flywheel means forming an ergometric system with variable input-responsive resistance determined by the way the exerciser uses the device and measurable by electronic means. Any of a number of ergometric variable input-responsive resistance systems may be coupled with the roller carriage on an adjustable inclined monorail. Using the inclined monorail permits unimpeded arm and leg movements while a user mounts a moving carriage on the monorail to pull the cables and move his or her body along the monorail. Using an ergometric input-responsive variable resistance simulates actual resistance conditions, wherein after overcoming the initial resistance of inertia with the body at rest, there is a sense of increased flow with increased speed aided by inertia with the body in motion. Hard fast motions increase resistance as in actual conditions. This simulation of actual inertial conditions with the body in motion along the monorail allows the user to experience the sensation and perception of actually performing the sports activity with the added advantage of being able to develop added strength and cardiovascular stamina to a greater extent than is possible in the actual activity, by increasing the incline or increasing the resistance by adjusting the ergometric input-responsive resistance or by merely increasing the speed and intensity of the user's movement. At the same time the activity can be monitored, interpreted and displayed with instant feedback by electronic means.

In addition to increased strength and endurance the training value of the invention is further enhanced because it is much easier to observe the actual movements made by the exerciser on the invention than in actual conditions of performing the sports activity. Any errors in form or technique may be observed and corrected by the exerciser observing his or her own activity in a mirror or on video or by a coach or trainer observing the exerciser.

A simple plate on top of the carriage with four holes for a fastening means such as a bolt mates with a matching plate on any of a variety of body supports for a variety of exercise activities simulating actual sports activities. The carriage accommodates, interchangeably, a side-to-side tilting platform for swimming training to simulate the actual body rotation involved in swimming as the arms are moved in swimming strokes, or a seat with a vertical foot rest for cross-country ski training to provide the correct upright posture involved in cross-country skiing, a bicycle seat and vertical support with rotating pedals or pivoting treadles, a recumbent cycle seat with horizontally mounted pedals, or another seat with a horizontal foot rest for canoe/kayak training to simulate the seated position involved in canoeing/kayaking. The platform and seats are interchangeable by bolting an attaching plate from the platform or seats to a plate on the top of the roller carriage.

The roller carriage has two upper and two lower rollers straddling the inclined monorail to insure smooth motion along the monorail with no binding.

The pull cables may be provided with anatomic hand paddles for swimming training, ski pole handles for nordic ski training, or canoe/kayak paddles for canoe/kayak training thereby simulating actual conditions. An additional pair of pull cables attached to the same ergometric system can be used to exercise the legs when the additional cables are attached to pivoting leg exercisers on the swimming platform or on the cross-country skiing vertical pivoting foot rests or on the pedals or treadles of the cycling simulator.

Other applications are also possible including a stair stepper added to the end of the frame working off of the same ergometric cable system by attaching the cables to the foot pedals which are hinged to the support.

A rubber tension safety line attaches between the rear support and the roller carriage to create tension and restrict the movement of the carriage beyond a set distance so the user will not bump into the front stanchion.

In all of the ergometric system of the present invention, the torque on the system is speed dependent so that the exerciser can hold position or move along the monorail depending on the speed of the exercise. Increased pull by the exerciser on the pull cables increases the variable resistance, but retains the sense of flow of a body in motion with moving inertia. Hard fast motions increase resistance as in actual conditions.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
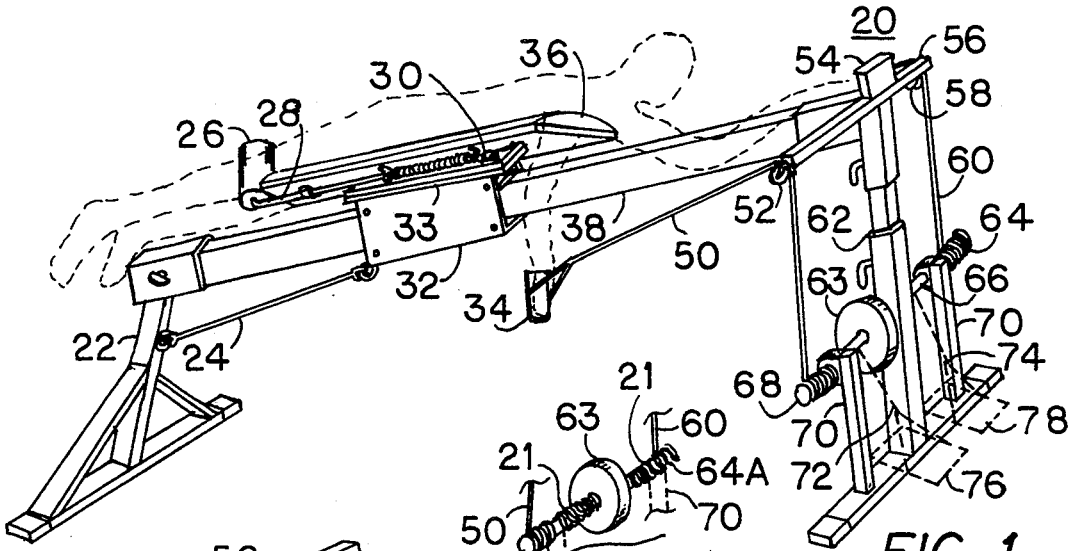
FIG. 1 is a perspective view of the preferred embodiment of the invention with a swimming body support pad attached to the carriage and a single rotatable shaft ergometric variable input-responsive resistance system with spring return spools for the pull cables and a single variable input-responsive resistance element.

In FIG. 1 the multifunction exercise machine 20 with ergometric variable input-responsive resistance comprises an angled telescoping front stanchion post 62, a rear stanchion assembly with a rear angled vertical post 22, and an inclined monorail 38 secured between the two stanchions with the front stanchion end of the monorail generally higher than a rear stanchion end of the monorail. The angle of incline of the monorail is adjustable by moving the telescoping front stanchion post 62 up or down. A roller carriage assembly 32 is movably mounted on the monorail to roll along the length of the monorall, wherein a mounting plate 33 on the roller carriage permits the attachment and detachment of a variety of user support assemblies 30. An elasticized strap 24 is attached between the roller carriage 32 and the rear stanchion 22 post.

Attached to the front stanchion cross bar 56, a pair of pulleys 52 and 58 receive a pair of pull cables 50 and 60, wherein the pull cables have, at a first end, mounting means for the attachment and detachment of handles B4, and the pull cables are secured, at a second end, to an ergometric variable input-responsive resistance assembly employing a flywheel 63 connected to a rotating shaft 66 propelled by the pull cables 50 and 60 attached to the rotating shaft by spring-loaded retracting one-way clutch drivers 68 and 64 respectively. The rotating shaft 66 is supported by ball bearings or brass bushings connected to side supports 70 on the front stanchion. The telescoping front stanchion post 62 is adjustable in height by a sliding post in sleeves with securing handles.

Figure 19:
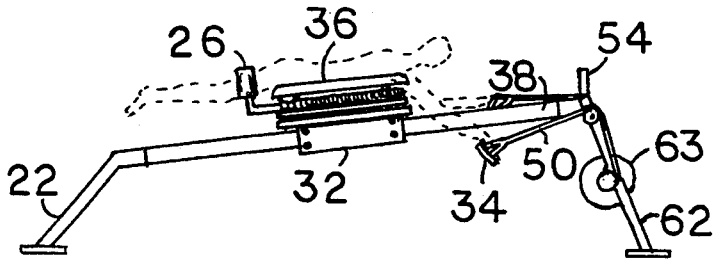
FIG. 19 is a simplified side elevational view showing Just the basic functioning of the invention with the swimming pad body support system mounted on the moving carriage.

Additionally attached to the front stanchion by hinges are a pair of stepper pedals 76 and 78 (shown dashed as an option) connected with pull cables 72 and 74 (shown dashed) which wind around the rotating shaft 66. This provides a stepping exerciser to simulate uphill climbing as indicated in FIG. 19 wherein the exerciser grasps the front stanchion cross bar 56 and operates the stepper pedals 76 and 78 with the feet. Alternately the hand pull cables 50 and 60 with ski handles 34A could be pulled rather than grasping the cross bar to combine a poling simulation with a ski climbing simulation.

Also mounted preferably in a highly visible location in the middle of the front stanchion cross bar 56, a monitor 54 which records the level of activity based upon electronic signals from standard sensors which measure the number of turns and the speed of turning of the rotating shaft or the flywheel, which information is translated electronically by standard electronic circuitry into speed and distance and energy output levels based upon the configuration of the equipment and depending on which sport is being simulated. The monitor is visible on both sides so that someone using either the carriage or the stepper exercising elements will be able to see the output on the monitor.

Alternative types of variable input-responsive resistance means with flywheels form ergometric systems with variable input-responsive resistance determined by the way the exerciser uses the device and measurable by the electronic means. In all of the ergometric systems of the present invention the torque on the system is speed dependent so that the exerciser can hold position or move along the monorail depending on the speed of the exercise. Increased pull by the exerciser on the pull cables increases the variable resistance, but retains the sense of flow of a body in motion with moving inertia. Hard fast motions increase resistance as in actual conditions.

Figure 2:
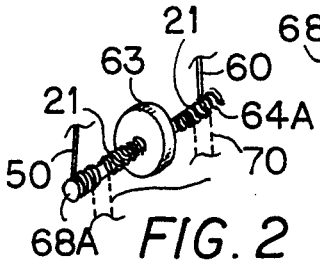
FIG. 2 is a partial perspective view of the invention showing the rotating shaft with an alternate cable return system using return springs on the rotating shaft.

FIG. 2 shows an alternate embodiment of the ergometric variable input-responsive resistance means with a flywheel 6B connected to a rotating shaft as in FIG. 1 with return springs 21 around the rotating shaft attached to the side supports 70 (shown dashed) and attached to the one-way clutch drivers 68A and 64A, wherein the return springs cause the pull cables 50 and 60 to rewind around the one-way clutch drivers 58A and 54A respectively.

Figure 3:
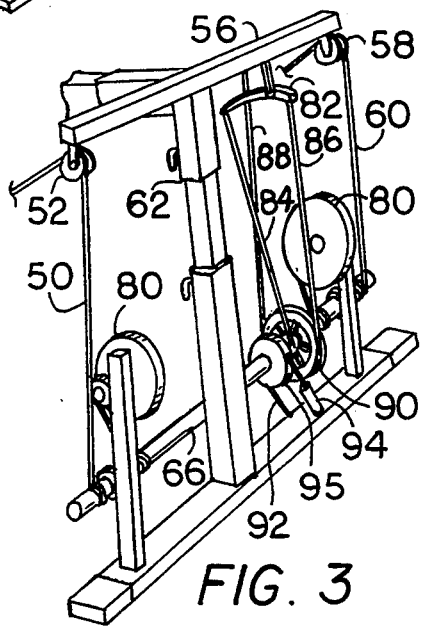
FIG. 3 is a partial perspective view of the invention showing the front stanchion with an alternate cable return system with a band brake on a flywheel and a centrifugal clutch.

FIG. 3 shows an alternate embodiment of the ergometric variable input-responsive resistance means with a centrifugal clutch 95 and a flywheel 90 with a band brake 86 creating the variable input-responsive resistance means. A rubber cord 92 connected to the base of the stanchion creates tension and returns the centrifugal clutch to its original position and a dashpot 94 consisting of a plunger or piston in a tight-fitting cylinder filled with water dampens the movement of the clutch for a smoother transition. A cord 84 from the clutch 95 connects to a lever 82 and a rubber belt 86 from the lever winds around the flywheel 90. The pull cables 50 and 60 wind over the pulleys 52 and 58 on the cross bar 56 and around the rotating shaft 66 which shaft runs through the centrifugal clutch 95 and flywheel 90. Spring-loaded return reels 80 on the stanchion are connected to the rotating shaft 66 by cables, cause the rotating shaft 66 to return to its original position after each pull of the pull cables, thereby returning the pull cables to their original positions ready to be pulled again. Increased pull by the exerciser on the pull cables increases the variable resistance in the clutch and flywheel system.

Figure 5:
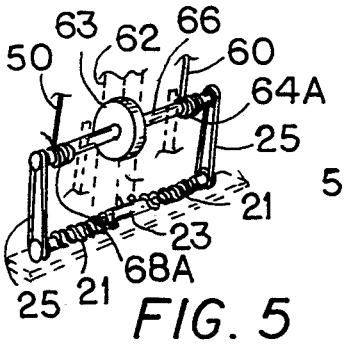
FIG. 5 is a partial perspective view of the invention showing the rotating shaft with an alternate cable return system using return springs on a parallel shaft communicating with the one-way clutch drivers on the rotating shaft by belts and pulleys.

In FIG. 5 an alternate embodiment of the ergometric variable input-responsive resistance means uses a flywheel 63 connected to a rotating shaft 66 as in FIG. 1 with return springs 21 around a parallel shaft 23 communicating with the one-way clutch drivers 68A and 64A on the rotating shaft 66 by belt and pulley systems 25. The return springs 21 are attached to the side supports (shown dashed), and the return springs 21 cause the pull cables 50 and 60 to rewind around the one-way clutch drivers 58A and 54A respectively.

Figure 6:
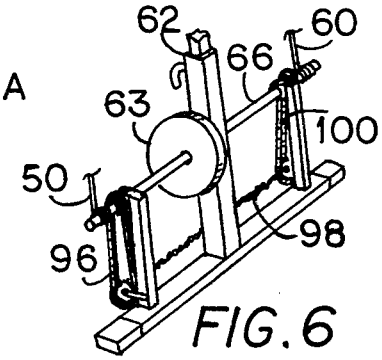
FIG. 6 is a partial perspective view of a portion of a front stanchion with an alternate cable recoil means using a double belt and pulley drive to two pulleys interconnected by a coiled rubber cord.

In FIG. 6 another alternative return system for the pull cables provides the pull cables 52 and 60 to wind around the rotating shaft 66 directly to turn the flywheel 6B. Belts 96 and 100 and pulleys or chains and sprockets connect the rotating shaft 66 to another pair of pulleys or sprockets interconnected by a strand of wound rubber loops 98 or a long coil spring serving as a tension member to return the rotating shaft and the pull cables to their original positions after each pull. A number of other possible cable return means include a return spring encircling the rotating shaft longitudinally.

Figure 7:
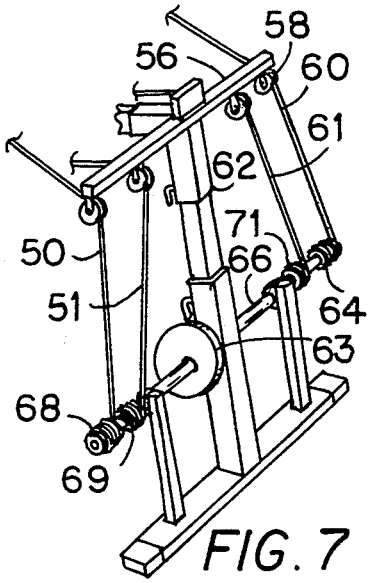
FIG. 7 is a partial perspective view showing the front stanchion of an alternate embodiment of the invention having two pull cords for the hands and two pull cords for the feet.
Figure 22:
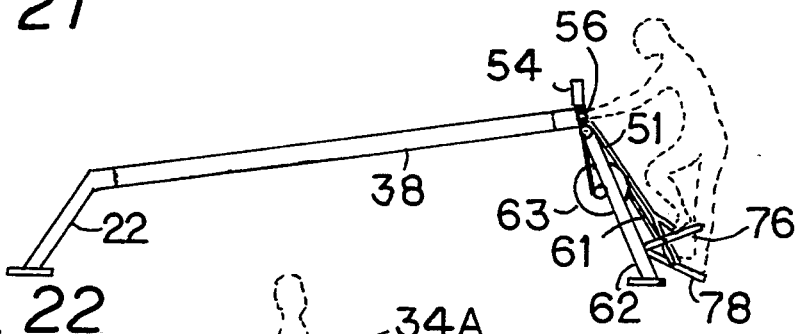
FIG. 22 is a simplified side elevational view showing Just the basic functioning of the invention with an exerciser using the step aerobic foot pedals mounted on the front stanchion.

In FIG. 7 an alternate embodiment of the invention has an additional pair of pull cables 51 and 61 winding around spring-loaded returning one-way drivers 69 and 71 on the rotating shaft 66. These cables 51 and 61 are pulled by the legs of a user, as in FIG. 20 with the pivoting vertical supports 48 free to rotate on nordic seat 47 assembly having pivoting vertical foot rests 48 from the assembly supporting foot pads 49, which are attached to the additional pull cables 51 and 61 to simulate both the skiing action on the pivoting foot pads 49 attached to pull cables 51 and 61 and the poling action with ski handle grips 34A attached to pull cables 50 and 60. The second pair of pull cables 51 and 61 may also be attached to padded leg supports 81 (as seen in FIGS. B and 21) for simulating the kicking motion involved in swimming while using the swim bench 36. The same additional pair of pull cables 51 and 61 could be turned around and connected to the stepper pedals 76 and 78, shown in FIGS. 1 and 22 with the user holding the front stanchion cross bar 56. The other pull cables 50 and 60 could alternately be connected to the stepper pedals. In the upright bicycle riding simulation embodiment of FIGS. 25, 26, and 27, and in the recumbent cycle riding simulation embodiment of FIG. 28, either pair of pull cables 51 and 61 or 50 and 60 may be attached to the peddles 49 or the treadles 162 of the invention.

In FIGS. 8–14 various alternative flywheel assemblies are shown which would replace the flywheel 63 on the rotating shaft 66 (in FIGS. 1, 2, 5, 6, and 7) or the clutch 90 on the rotating shaft 66 (in FIG. 3).

Figure 8:
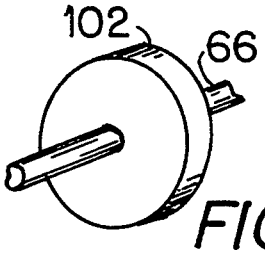
FIG. 8 is a partial perspective view of a centrifugal brake speed regulator used as the ergometric variable input-responsive resistance means on the rotating shaft of FIG. 1.

In FIG. 8 the alternative flywheel assembly on the rotating shaft 66 comprises a centrifugal brake. As the flywheel rotates faster, elements in the centrifugal brake pivot outwardly under centrifugal force to provide a braking or speed regulating function.

Figure 9:
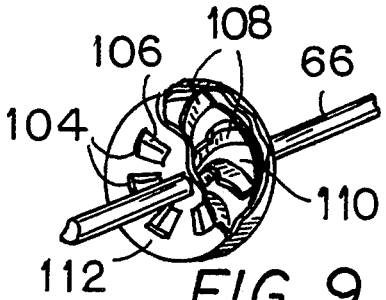
FIG. 9 is a partial perspective view of a vaned flywheel inside an enclosed case with variable vents used as the ergometric variable input-responsive resistance means on the rotating shaft of FIG. 1.

In FIG. 9 the ergometric variable input-responsive resistance means on the rotating shaft of FIG. 1 comprises a vaned flywheel 110 with curved vanes 108 inside an enclosed case 112 with spaced openings 104 on the vaned side of the flywheel, which spaced openings 104 are controlled by variable vents 106 which create more resistance by closing down the openings.

Figure 10:
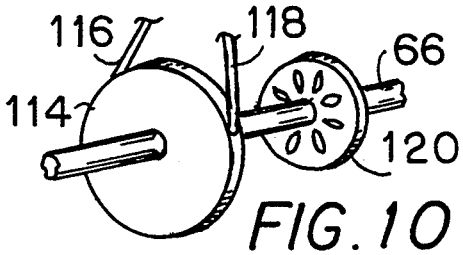
FIG. 10 is a partial perspective view of a flywheel with a band brake and separate wind resistance fan wheel used as the ergometric variable input-responsive resistance means on the rotating shaft of FIG. 1.
Figure 11:
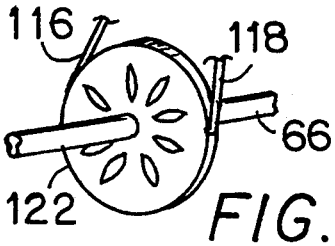
FIG. 11 is a partial perspective view of a single flywheel with a band (capstan) brake and a built in wind resistance fan used as the ergometric variable input-responsive resistance means on the rotating shaft of FIG. 1.

In FIG. 10 a flywheel with a band brake 114 is coupled with a small fan blade 120 both on the rotating shaft 66 to create a "wind load" with the brake for additional variable input-responsive resistance in the system. Band 116 is attached to a rigid point on the stanchion and band 118 may be tightened or loosened to vary the resistance adjustably. In FIG. 11 the fan blades are incorporated in the band brake flywheel and fan to create a wind load band brake flywheel 122. Increased force on the pull cables by the exerciser increases the variable input-responsive resistance created by the "wind load" coupled with the brake resistance.

Figure 12:
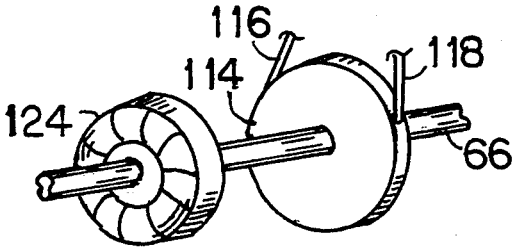
FIG. 12 is a partial perspective view of a flywheel with a band (capstan) brake and a separate water load having an impeller rotating in a water-filled container used as the ergometric variable input-responsive resistance means on the rotating shaft of FIG. 1.
Figure 13:
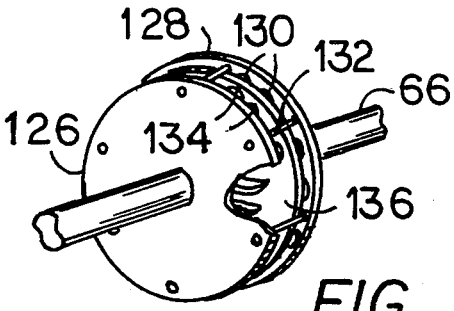
FIG. 13 is a partial perspective view of a magnetic (eddy current) three wheeled interconnected system used as the ergometric variable input-responsive resistance means on the rotating shaft of FIG. 1.

In FIG. 12 a band brake flywheel 114 is coupled with a "water load" 124 both attached to the rotating shaft 66. The water load 124 comprises a rotating impeller inside a container filled with water. Increased force on the pull cables by the exerciser increases the variable resistance created by the "water load" coupled with the brake resistance.

In FIG. 1B a magnetic (eddy current) lead unit is used to create the variable input-responsive resistance on the rotating shaft 66. A stationary disk 126 with spaced magnets around the circumference is connected by standoff pins 132 to an adjustably turnable stationary disk 128 with spaced magnets around the circumference. A rotating conductive disk 136 with wind vanes for cooling is positioned rotatably between the other disks fixedly attached to the rotating shaft 66. As the conductive disk 136 turns in response to the rotating shaft, the conductive disk cuts the magnetic flux lines to create a torque resistance proportional to the number of flux lines, the speed, the radius, and inversely proportional to the resistance of the conductive disk.

Figure 14:
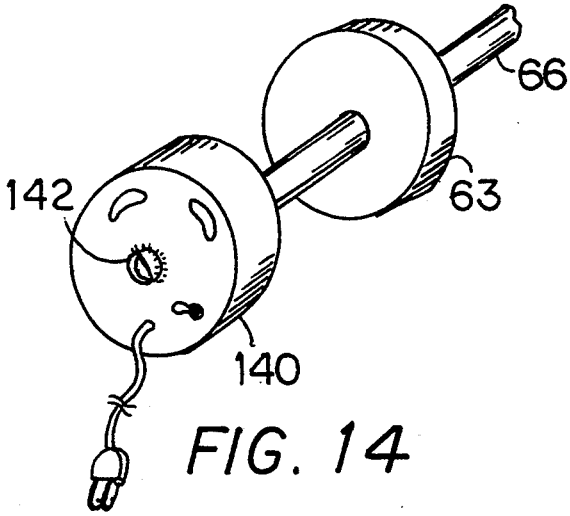
FIG. 14 is a partial perspective view of a variable speed electric motor and flywheel system used as the ergometric variable input-responsive resistance means on the rotating shaft of FIG. 1.

In FIG. 14 a variable speed electric motor 140 with variable speed control knob 142 is used to create the variable input-responsive resistance on the rotating shaft 66 along with the flywheel 63. The motor turns the rotating shaft to create the sensation of inertia in motion. When the exerciser attempts to pull on the pull cables to rotate the shaft at a speed faster than the motor, the motor and flywheel create a resistance simulating the natural resistance of a body moving in water or snow for building strength and endurance.

Figure 15:
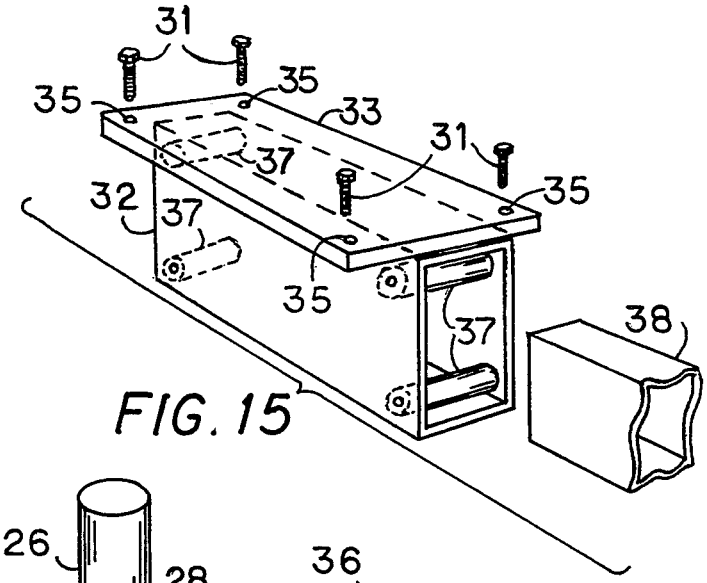
FIG. 15 is a partial perspective view showing the moving carriage with rollers that moves along the monorail with the top mounting plate.

In FIG. 15, the roller carriage assembly comprises a body portion 32 formed as an elongated hollow tube rectangular in cross-section. Inside the body portion adjacent to each open end top and bottom rollers 37 are rotatably attached to the interior of the body portion. The rollers engage the top and bottom surfaces of the rectangular monorail 38 on which the carriage assembly rides. Welded or bolted or otherwise permanently attached to the top of the carriage assembly, a receiving plate 33 is provided with a hole 35 through the plate at each of its four corners to receive a bolt 31 or other attaching means for connecting interchangeably any of a number of body supports to the carriage assembly. The rolling of the roller carriage assembly along the monorail moves the body of the exerciser along the monorail to simulate the motion the exerciser would experience in the actual activity.

Figure 16:
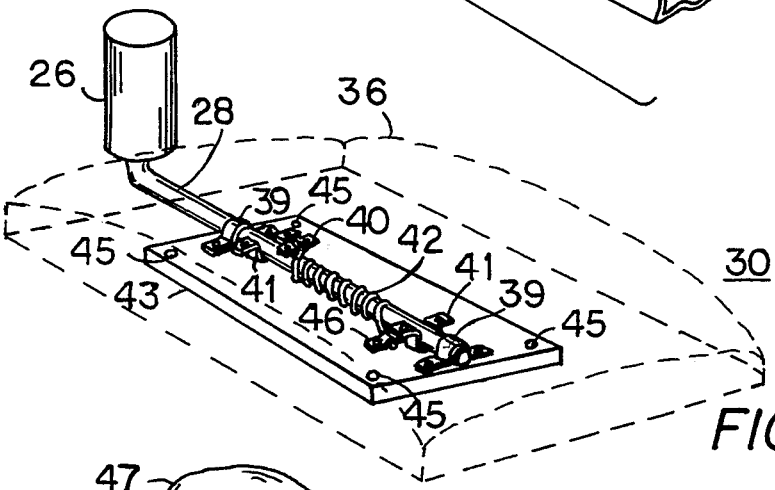
FIG. 16 is a perspective view of the swimming body support pad (shown dashed) and the spring body support system that mounts on the mating mounting plate of FIG. 12.

In FIG. 16 a side-to-side tilting swim bench 30 has a top padded bench 36 (shown dashed) on which the exerciser lies prone or supine while gripping the extending cylindrical padded grip 26 between the thighs as in FIGS. 1 and 19. As the exerciser (shown dashed) makes the stroking motions of swimming, while pulling on swim paddle handles 34 attached to the pull cables 50 and 60 connected to one embodiment of the ergometric input-responsive resistance system described above, the padded bench tilts from side to side pivoting on the cylindrical shaft as the body would twist in the water, thereby simulating the natural body motions in swimming. The thighs of the exerciser holding the padded grip on the bent end of the shaft 28 makes the shaft rotate, thereby tilting the padded bench. A spring 42 around the cylindrical shaft 28 tends to bring the padded bench back to a horizontal position. Brackets 41 secure the cylindrical shaft to the padded bench and brackets 39 secure the cylindrical shaft to the attaching plate 43. A clamp 40 secures one end of the spring 42 to the padded bench 36 and a clamp 46 secures the opposite end of the spring 42 to the attaching plate 43. The tilting padded bench assembly is removably attached by pins or bolts or other removable means through corner holes 45 securing the attaching plate 43 to the mating receiving plate 33 on the roller carriage which rolls on the monorail simulating the actual motion through the water in swimming.

Figure 4:
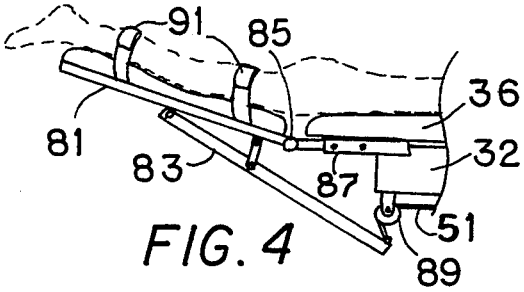
FIG. 4 is a partial side elevational view showing a leg exerciser unit.
Figure 24:
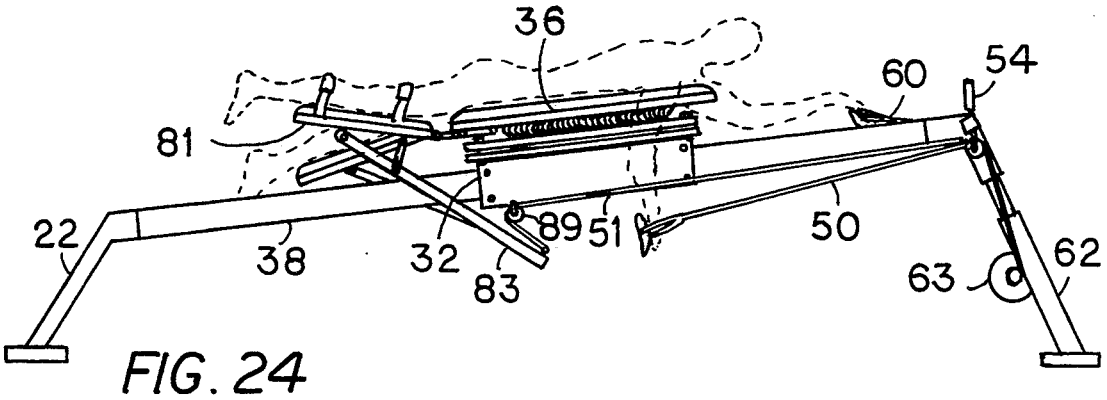
FIG. 24 is a simplified side elevational view showing Just the basic functioning of the invention with an alternate embodiment of the swimming pad body support system, including pivoting leg supports, mounted on the moving carriage.

FIG. 4 shows an additional feature which may be used with the padded swimming bench 36 of FIGS. 1, 16, 19, and 24 for exercising the legs of the swimmer. A pair of padded leg supports 81 are mounted, spaced apart on either side of the monorail, each on a telescoping bracket 87 with a pivot 85 to allow the leg support to be pivoted up and down. As the leg support 81 is pivoted downward, a rod 83 from the underside of the leg support draws the cable 51 through the pulley 89 connected to the underside of the rolling carriage 82. The cable 51, as seen in FIGS. 7 and 24, is connected to the same egometric user-responsive variable resistance as the hand cables. Leg straps 91 adjustably secured by Velcro (TM) fasteners enable the exerciser to lift the leg supports by elevating the legs. Weights may be added to the legs to gain additional resistance over the weight of lifting the leg and leg support during the upstroke of the leg. Arm and leg movements can be coordinated to simulate actual swimming motion with the simulated resistance and actual motion as experienced in swimming as seen in FIG. 24.

Figure 17:
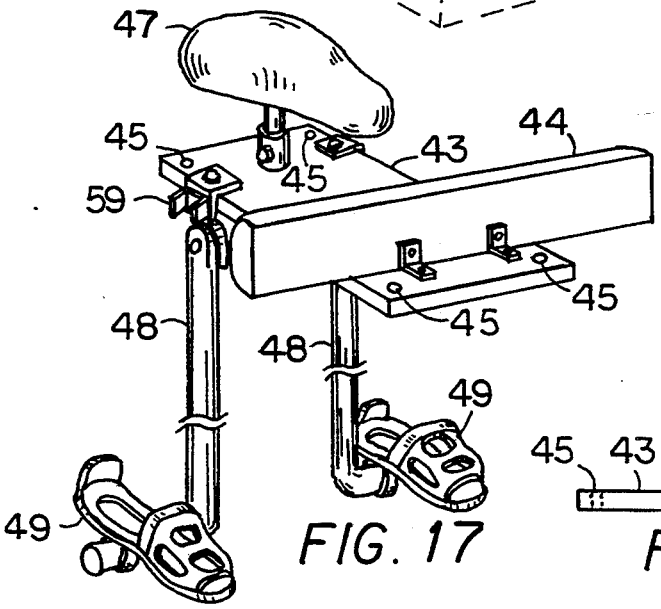
FIG. 17 is a partial perspective view of the nordic skiing seat, thigh pad, and vertical pivoting footrest body support system that mounts on the mating mounting plate of FIG. 12.
Figure 20:
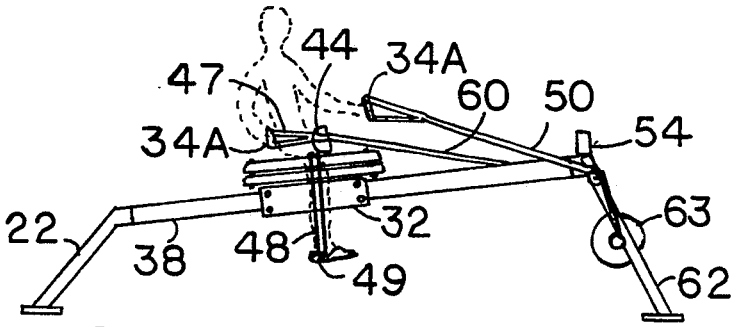
FIG. 20 is a simplified side elevational view showing Just the basic functioning of the invention with the nordic skiing body support system mounted on the moving carriage.
Figure 23:
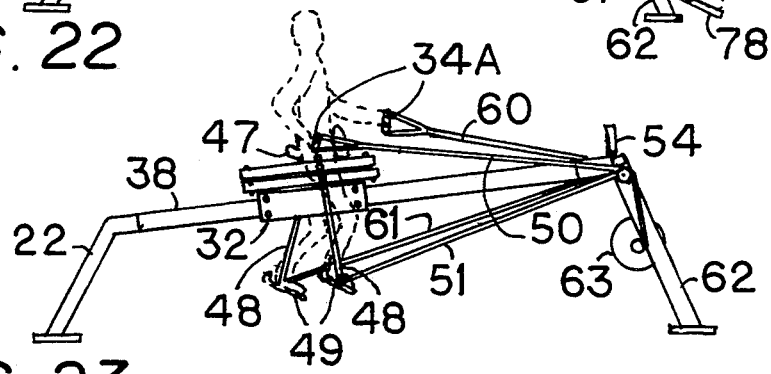
FIG. 23 is a simplified side elevational view showing Just the basic functioning of the invention with an alternate embodiment of the nordic skiing body support system mounted on the moving carriage, wherein the foot rests pivot allowing the legs to move two additional leg pull cables.

In FIG. 17 a nordic seat assembly has a seat 47 and a thigh pad 44 to brace the front of the legs and pivotable foot pedals 49 vertically below the seat. The pivotable foot pedals 49 are secured by pivoting vertical supports 48 to the attaching plate 43 which is attached by bolts or other means through corner holes 45 to the mating receiving plate BE of the carriage assembly. The pivoting vertical supports 48 may be held stationary in a rigid vertical position (as shown in FIG. 20) by a retaining means such as the U-clamp 59 (as seen in FIG. 17) which pivots down to hold the vertical support 48 in a rigid vertical position. The exerciser (shown dashed) sits on the seat with legs braced against the thigh pad and feet on the foot rest as in FIGS. 20 and 23. The exerciser pulls on simulated ski pole grips 34A attached to the pull cables 50 and 60 of one of the ergometric variable input-responsive resistance systems described above. In FIG. 23 the exerciser also moves his or her legs to pull on the additional foot pullcables 51 and 61 connected to the ergometric resistance system. The nordic seat system moves on the sloped monorail 38 simulating the movement in cross-country skiing.

Figure 18:
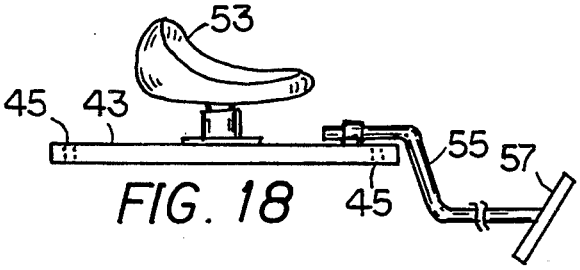
FIG. 18 is a partial side elevational view of the canoe/kayak seat and horizontal foot rest body support system that mounts on the mating mounting plate of FIG. 12.
Figure 21:
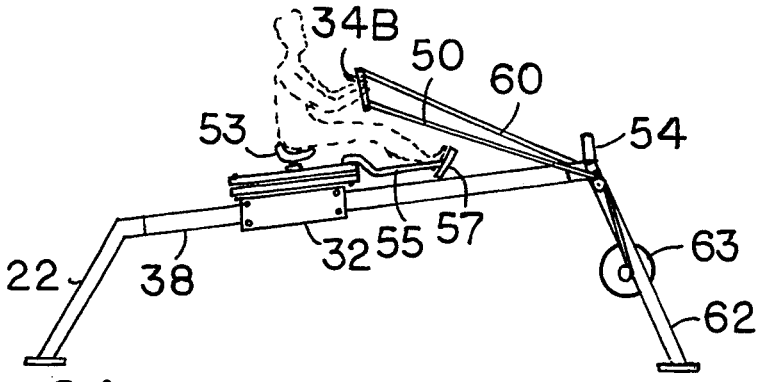
FIG. 21 is a simplified side elevational view showing Just the basic functioning of the invention with the canoe/kayak body support system mounted on the moving carriage.

In FIG. 18 a canoe or kayak simulation seat assembly has a seat 53 and an extension arm 55 supporting an angled foot rest 57 horizontally in front of the seat. The seat and foot rest extension arm are secured to the attaching plate 43 which is attached by bolts or other means through corner holes 45 to the mating receiving plate 33 of the carriage assembly. As in FIG. 21 the exerciser (shown dashed) sits on the seat 53 and straddles the extension arm 55 with one foot on each side of the extension arm resting on the angled foot rest 57. The exerciser uses a simulated paddle handle 34B attached to the two pull cables 50 and 60 to simulate paddling. The pull cables are attached to one of the ergometric variable input-responsive resistance means. Removably secured to the carriage the canoe/kayak assembly moves along the monorail simulating actual motion in the canoe or kayak.

Figure 25:
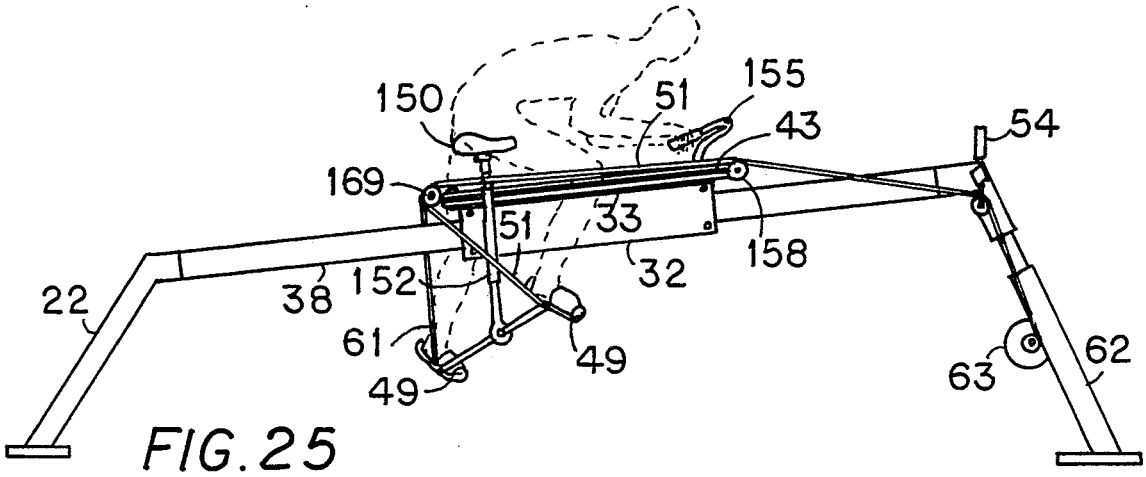
FIG. 25 is a simplified side elevational view showing Just the basic functioning of the invention with an upright bicycle simulation system, mounted on the moving carriage.
Figure 26:
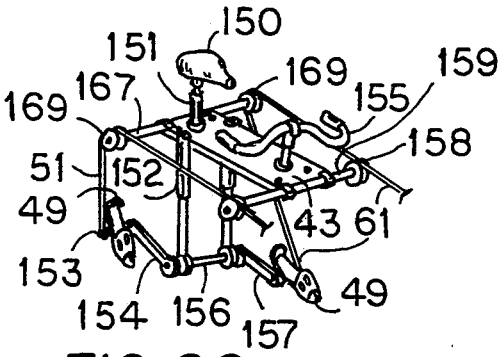
FIG. 26 is a partial perspective view of the upright bicycle simulation body support system, with pedals, that mounts on the mating mounting plate of FIG. 12.
Figure 27:
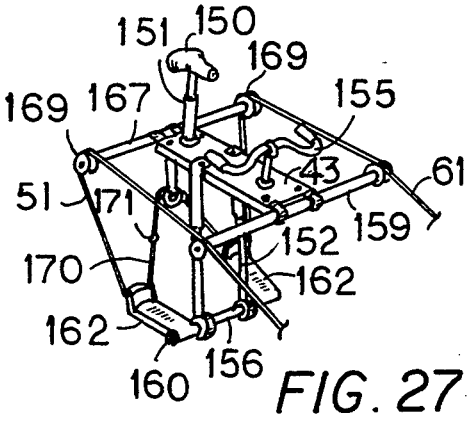
FIG. 27 is a partial perspective view of an alternative upright bicycle simulation body support system with treadles.
Figure 28:
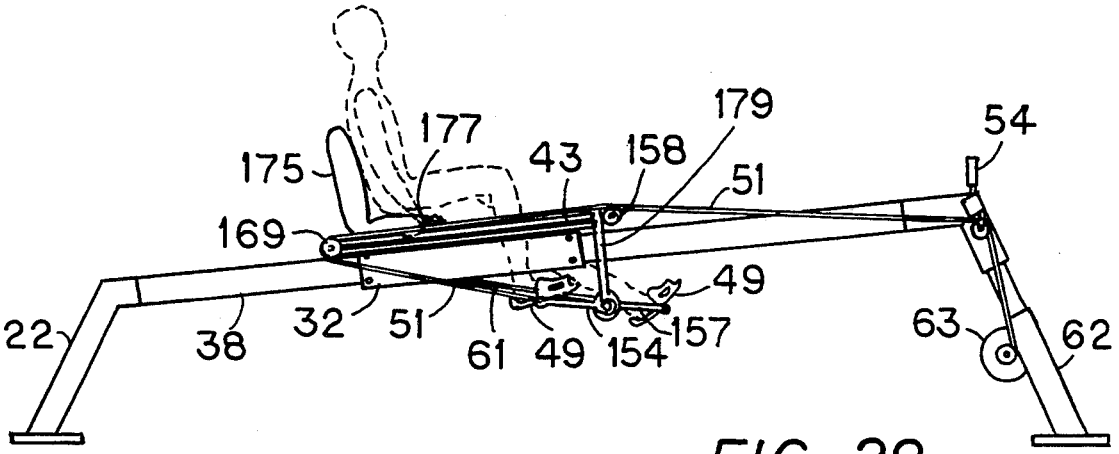
FIG. 28 is a simplified side elevational view showing Just the basic functioning of the invention with a recumbent bicycle simulation system.

In FIGS. 25, 26, and 27 an upright bicycle simulation seat assembly comprises a bicycle seat 150 mounted on a height-adjustable telescoping post 151 which is mounted on the attaching plate 43 which attaches to the mating receiving plate 33 on the carriage assembly. In front of the bicycle seat an appropriate distance comparable to a standard bicycle, a bicycle handle bar 155 in mounted on a telelcoping adjustable post attached to the attaching plate. Across the front of the attaching plate a first pulley support shaft 158 has an outrigger rotatable pulley 158 at each end to receive the pull cables 51 and 61 (or 50 and 60) from the ergometric resistance system. The pull cables 51 and 61 then pass over aligned outrigger rotatable pulleys 169 on a second pulley support shaft 167 attached across the back edge of the attaching plate 43. From the rear-mounted pulleys 169 the pull cables 51 and 61 then connect to an outer point on the pivot arm 153 to which the pedals 49 are pivotally attached or to a back point on the treadles 162, wherein the pedals and treadles can be moved and pull the pull cables with the user experiencing resistance on the pedals and treadles in the same orientation they would experience the resistance in an actual upright bicycle or treadle cycle. Adjustable telescoping vertical pedal supports 152 extend downwardly from the attaching plate 43. Attached across the base of the vertical pedal supports 152, a horizontal pedal support shaft 156 receives two pedal arms 154 rotatably attached to the ends of the pedal support shaft 156, thereby coordinating the motion of the two pedals. Attached to the pedal arms 154 and 157, pivotable foot pedals 49 have toe clips and heel supports to maintain the feet on the pedals. The pull cables 51 and 61 attach to the outside edges of the foot pedals at the pivot point 153 so that a normal pedaling motion pulls the pulls cables and the feel of pedaling simulates actual pedaling on a bicycle. Alternately, in FIG. 27, pedal support shaft extensions 160 rotatably support pivotable treadles 162. The pull cables 51 and 61 attach to the rear of the treadles, so that a downward thrust on the treadles pulls the pull cables. An additional cable 170 connects the two treadles over a lateral pulley to coordinate the respective movement of the two treadles. A stop 171 on each side of the lateral pulley stops the downward movement of one treadle, at which time the opposite treadle is in a maximum vertical position ready for a downward thrust. Removably secured to the carriage the upright bicycle and treadle cycle assemblies move along the monorail simulating actual motion on a bicycle or treadle cycle.

In FIG, 28, a recumbent bicycle simulator comprises, on the support assembly, a back-supporting seat 175 and horizontally extending pedals 49 in front of the back-supporting seat. A pedal support arm 179 extends down from the attaching plate 43 to support a similar pedal system as the system shown in FIG. 26, except in this recumbent embodiment the pedals are positioned horizontally in front of the seat. The pedal support arm 179 may extend above the attaching plate 43 to locate the pedals above the attaching plate and, correspondingly, above the inclined monorail 48. The outrigger rotatable pulleys 158 and 169 are positioned in a similar location to the system in FIG. 26 to provide resistance on the pedals simulating the resistance that would be experienced in pedaling an actual recumbent cycle. Pedaling pulls on the pull cables 51 and 61 attached to the ergometric variable input-responsive resistance system to simulate actual resistance conditions. Removably secured to the carriage the recumbent bicycle assembly moves along the monorail simulating actual motion on a recumbent bicycle.

In all of these systems the motion of the body of the exerciser on the roller carriage along the monorail simulates actual motion of the body in the sport. The variable input-responsive resistance created on the pull cables simulates the actual resistance experienced by the exerciser in the actual sports activity. Initial resistance is high due to inertia. Then inertia in motion simulates lowered resistance as in gliding through the water or over the snow or along the bicycle trail. But increased pull by the exerciser also increases the resistance in the system simulating the resistance the exerciser would actually experience in the sports activity by trying to pull harder through the water or on the handle of a ski pole or paddle or pedal harder. Increased pull by the exerciser on the pull cables increases the variable resistance, but retains the sense of flow of a body in motion with moving inertia. Hard fast motions increase resistance as in actual conditions. Increasing the incline of the adjustable monorail would create increased strain on the exerciser, thereby developing more strength. The stair stepper exerciser would have a similar related effect; as the exerciser tried to push down faster or harder on the foot pedals the variable input-responsive resistance would increase as in the increased difficulty of trying to speed up in actual stair climbing.

Structural components of the invention are made of high strength but relatively light weight steel or aluminum. Cables are preferably fabricated of nylon or polypropylene cord for strength and durability.

It is understood that the preceding description is given merely by way of illustration and not in limitation of the invention and that various modifications may be made thereto without departing from the spirit of the invention as claimed.

I claim:

1. A multifunction sports simulation exercise machine with ergometric input-responsive variable resistance comprising:

a front stanchion assembly;

a rear stanchion assembly;

an inclined monorail secured between the two stanchions with a front stanchion end of the monorail generally higher than a rear stanchion end of the monorail;

wherein the angle of incline of the monorail is adjustable;

a roller carriage assembly having top and bottom pairs of rollers to engage the monorall, wherein the roller carriage is movably mounted on the monorail to roll along the length of the monorail, wherein a mounting means on the roller carriage permits the attachment and detachment of a variety of user body support assemblies;

attached to the front stanchion, at least one pair of pulleys, through which pulleys pass at least one pair of pull cables, wherein the pull cables have, at a first end, mounting means for the attachment and detachment of pull means simulating sports equipment, and the pull cables attach, at a second end, to one-way clutch drivers which drive a rotating shaft having an ergometric input-responsive variable resistance assembly; wherein a tension means is attached to the one-way clutch drivers, which tension means retracts the pull cables after each pull.

2. The invention of claim 1 further comprising an elasticized strap attached between the roller carriage and the rear stanchion.

3. The invention of claim 2 further comprising an electronic means for monitoring, interpreting, and displaying the performance level of a user with a means for measuring number of rotations and speed of rotation of the rotating shaft, an electronic means for interpreting user input based on the configuration of the invention and depending on which sport is being simulated, and an electronic monitor means for displaying information about user physical output.

4. The invention of claim 3 wherein the mounting means comprises a receiving plate permanently attached to the roller carriage, which receiving plate mates with an attaching plate on each of the body support assemblies, which plates are secured together.

5. The invention of claim 4 wherein the user body support assembly comprises a padded swim bench which pivots transversely to the monorail and the handles comprise swimming paddles.

6. The invention of claim 5 further comprising a pair of pivoting leg supports pivotally attached to the padded swim bench, wherein the pivoting leg supports have a means to pull cables attached to the ergometric input-responsive variable resistance assembly.

7. The invention of claim 4 wherein the user body support assembly comprises a seat with a footrest vertically below the seat and a thigh rest pad in front of the seat, and the handles comprise simulated ski pole handles.

8. The invention of claim 7 wherein the footrest comprises two separate foot rests supported from the carriage assembly by pivotable supports, and the foot rests are attached to additional pull cables attached to the rotating shaft, wherein the foot rests are pivotable.

9. The invention of claim 4 wherein the user support assembly comprises a seat with a footrest extended horizontally in front of the seat and the handles comprise simulated paddle shafts.

10. The invention of claim 4 wherein the support assembly comprises a bicycle seat, a handle bar in front of the bicycle seat, and pedals below the bicycle seat.

11. The invention of claim 4 wherein the support assembly comprises a bicycle seat, a handle bar in front of the bicycle seat, and treadles below the bicycle seat.

12. The invention of claim 4 wherein the support assembly comprises a recumbent back-supporting seat and horizontally extending pedals in front of the recumbent back-supporting seat.

13. The invention of claim 3 wherein the ergometric variable input-responsive resistance assembly comprises a centrifugal clutch secured to the rotating shaft and the pull cables wind around one-way clutch drivers which drive the rotating shaft, wherein a tension means connected to the one-way clutch drivers rewinds the pull cables to an initial position after extension.

14. The invention of claim 3 wherein the ergometric variable input-responsive resistance assembly comprises a vaned flywheel, which vaned flywheel has curved vanes extending from a side of the flywheel, and wherein the vaned flywheel is rotatably mounted inside an enclosed casing with variable openings on the vaned side of the vaned flywheel; and wherein the encased vaned flywheel is secured to the rotating shaft and the pull cables wind around one-way clutch drivers which drive the rotating shaft, wherein a tension means connected to the one-way clutch drivers rewinds the pull cables to an initial position after extension.

15. The invention of claim 3 wherein the ergometric variable input-responsive resistance assembly comprises a flywheel with a band brake secured to the rotating shaft and a disk with fan blades is also secured to the rotating shaft, and wherein the cables are wound around one-way clutch drivers which drive the rotating shaft, wherein a tension means connected to the one-way clutch drivers rewinds the pull cables to an initial position after extension.

16. The invention of claim 3 wherein the ergometric variable input-responsive resistance assembly comprises a flywheel with a band brake secured to the rotating shaft and a wheel having impeller blades spinning in a water-filled container secured to the rotating shaft, and wherein the cables are wound around one-way clutch drivers which drive the rotating shaft, wherein a tension means connected to the one-way clutch drivers rewinds the pull cables to an initial position after extension.

17. The invention of claim 3 wherein the ergometric variable input-responsive resistance assembly comprises an eddy current resistance means comprising a pair of spaced apart stationary disks with magnets positioned around a perimeter of each disk and a rotating conductive disk in between the stationary disks with the rotating conductive disk attached to the rotating shaft, and wherein the cables are wound around one-way clutch drivers which drive the rotating shaft, wherein a tension means connected to the one-way clutch drivers rewinds the pull cables to an initial position after extension.

18. The invention of claim 3 wherein the ergometric variable input-responsive resistance assembly comprises a centrifugal brake secured to the stanchion and to the flywheel, and wherein the cables are wound around one-way clutch drivers which drive the rotating shaft, wherein a tension means connected to the one-way clutch drivers rewinds the pull cables to an initial position after extension.

19. The invention of claim 3 wherein the ergometric variable input-responsive resistance assembly comprises a variable speed electric motor connected to the rotating shaft, and wherein the cables are wound around one-way clutch drivers which drive the rotating shaft, wherein a tension means connected to the one-way clutch drivers rewinds the pull cables to an initial position after extension.

20. The invention of claim 3 further comprising a pair of stepper pedals pivotally attach to the front stanchion, wherein a cable from each stepper winds around one-way clutch drivers which drive the rotating shaft, wherein a tension means connected to the one-way clutch drivers rewinds the pull cables to an initial position after extension.

* * * * *